United States Patent [19]

Hamilton et al.

[11] Patent Number: 4,848,260

[45] Date of Patent: Jul. 18, 1989

[54] MODULAR SYSTEM FOR MARINE FLOATS

[75] Inventors: Kris P. Hamilton, Bellingham; Brian H. Glover, Bainbridge Island; Larry R. Halgren, Bellingham; Warren S. Mills, Everson, all of Wash.

[73] Assignee: Bellingham Marine Industries, Inc., Bellingham, Wash.

[21] Appl. No.: 57,998

[22] Filed: Jun. 4, 1987

[51] Int. Cl.[4] ..... E01D 15/14

[52] U.S. Cl. ..... 114/266; 114/267

[58] Field of Search ..... 441/129; 114/263, 264, 114/266, 267, 258, 261, 262; 405/218, 219; 14/2.6, 27–30; 52/582, 583

[56] References Cited

U.S. PATENT DOCUMENTS

| | | | |
|---|---|---|---|
| 1,900,319 | 3/1933 | Vermeulen | 114/266 |
| 2,430,178 | 11/1947 | Kurfiss | 114/266 |
| 3,057,315 | 10/1962 | Robishaw | 114/266 |
| 3,091,203 | 5/1963 | Usab | 114/266 |
| 3,152,568 | 10/1964 | Mayer | 114/266 |
| 3,323,479 | 6/1967 | Filak | 114/266 |
| 3,448,709 | 6/1969 | Hardwick, Jr. | 114/266 |
| 3,587,503 | 6/1971 | Stehr | 114/266 |
| 3,763,808 | 10/1973 | Smith | 114/266 |
| 3,970,024 | 7/1976 | Fisher | 114/266 |
| 4,286,538 | 9/1981 | Matsui | 114/266 |
| 4,655,156 | 4/1987 | Suirklys | 114/266 |

FOREIGN PATENT DOCUMENTS

| | | | |
|---|---|---|---|
| 86339/75 | 5/1979 | Australia | 114/267 |
| 21680/83 | 5/1984 | Australia | 114/267 |
| 2357343 | 5/1974 | Fed. Rep. of Germany | 114/266 |

*Primary Examiner*—Joseph F. Peters, Jr.
*Assistant Examiner*—Clifford T. Bartz
*Attorney, Agent, or Firm*—Seed and Berry

[57] ABSTRACT

A float system comprised of modular units assembled to form relatively rigid floating assemblies in a plurality of configurations is provided. In a preferred embodiment comprising a basic two-tier assembly, the modular units form upper and lower layers which combine to define a buoyant, protected shell. The units are preferably interchangeable so that they may be used for either the upper or lower layer and are assembled in a staggered manner to form overlapping connections. The modular units may be assembled using a buoyant lower layer and a non-buoyant upper layer, or using more than two buoyant layers if desired. Preferred embodiments for unevenly loaded structures include multilayer portions at locations on the structure corresponding to increased loads.

16 Claims, 5 Drawing Sheets

FIG. 3
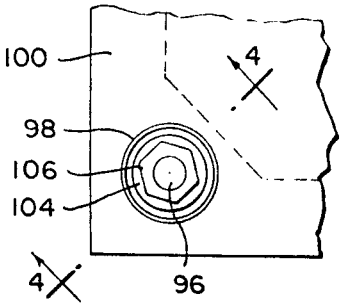
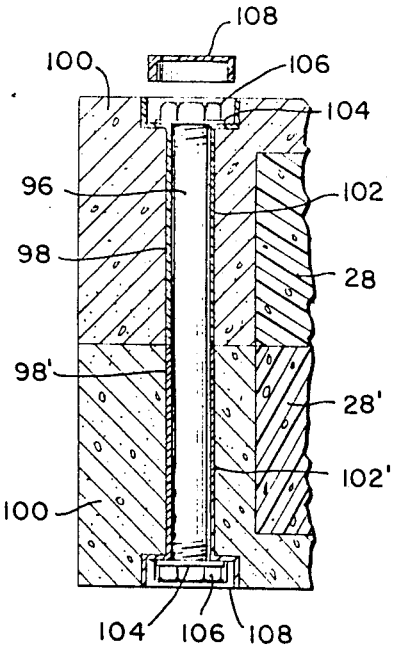
FIG. 4
FIG. 5
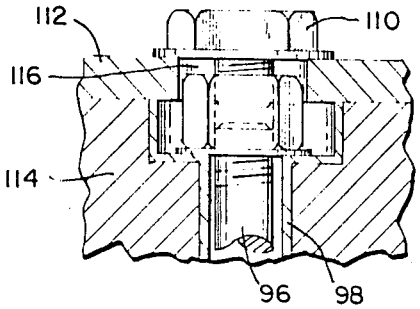
FIG. 6
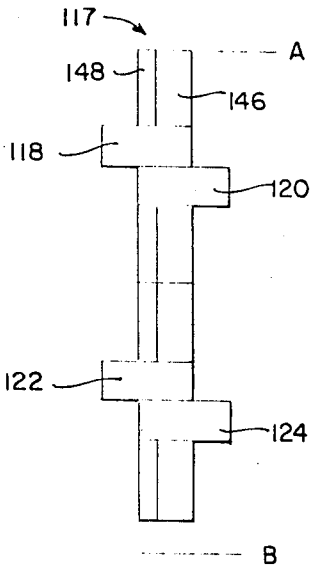
FIG. 7
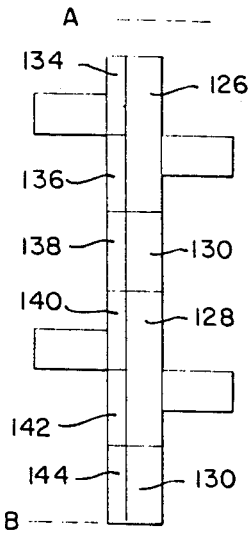

FIG. 8
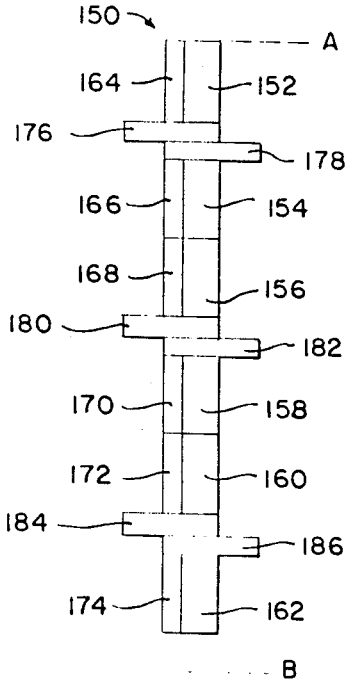
FIG. 9
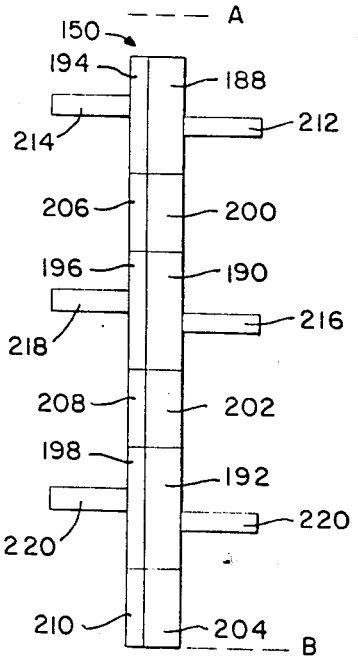
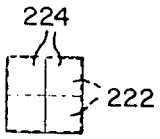
FIG. 10
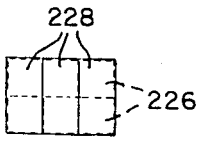
FIG. 11
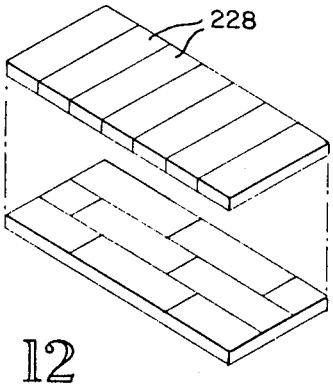
FIG. 12
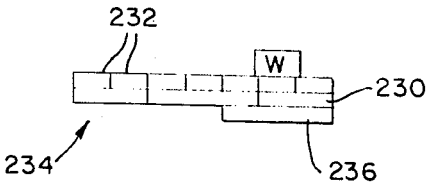
FIG. 13

FIG. 15
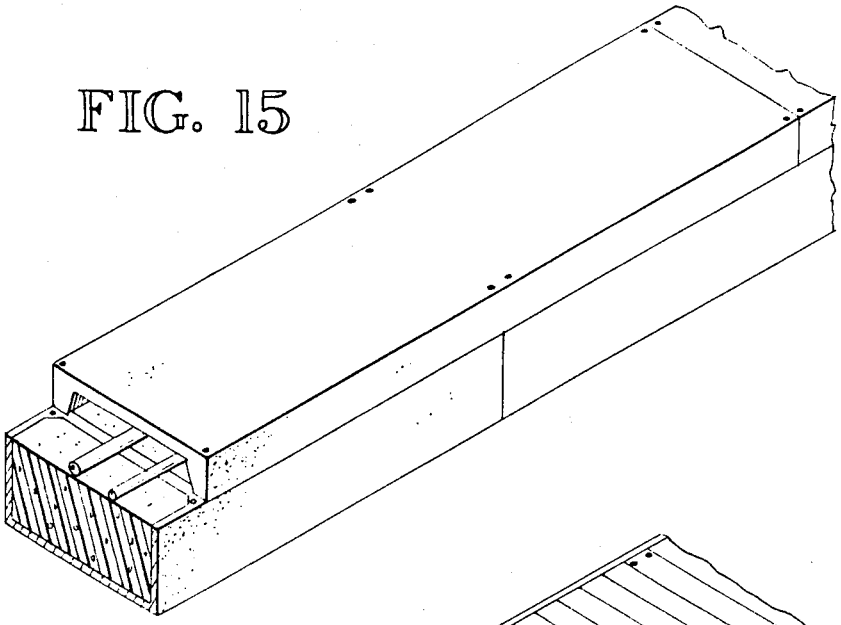
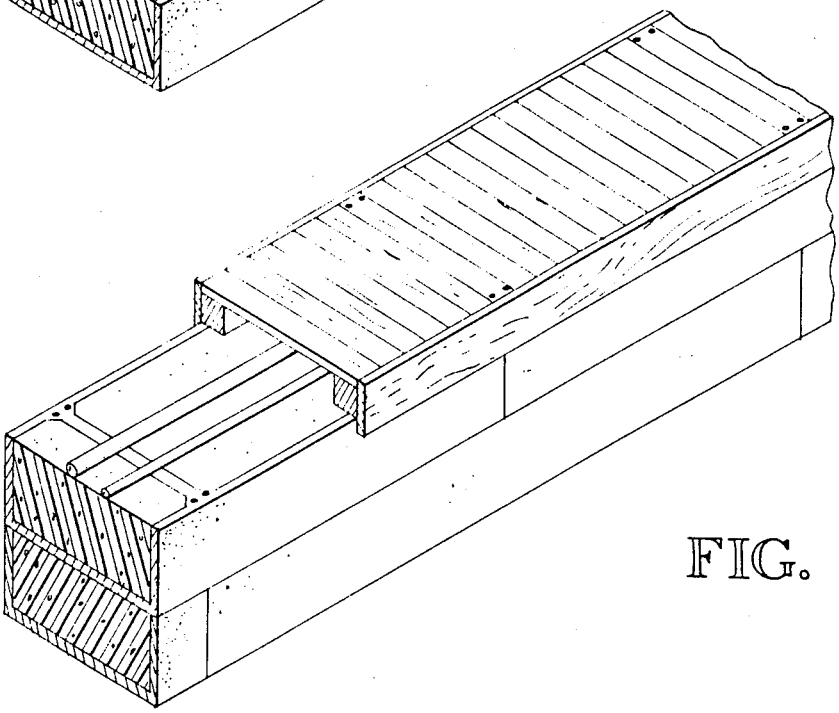
FIG. 16

MODULAR SYSTEM FOR MARINE FLOATS

This application is a substitute application of Ser. No. 814,272, filed Dec. 19, 1985 and subsequently abandoned, which is a continuation of patent application Ser. No. 596,622, filed Apr. 4, 1984 and subsequently abandoned.

TECHNICAL FIELD

This invention relates to marine floats, and more particularly, to modular floats adapted for constructing improved docking structures, floating foundations, and the like.

BACKGROUND ART

Floating piers and similar dock structures are commonly formed by connecting a number of marine floats. Such floats typically comprise a concrete shell which surrounds a foam core or hollow core, as illustrated in U.S. Pat. No. 3,091,203, to Usab, and U.S. Pat. No. 3,448,709, to Hardwick, Jr. These floats include an upper deck surface which can be integrally formed with the remainder of the concrete shell or formed as a separate piece and connected to the remainder of the shell at the time of final construction, as disclosed in the patent to Hardwick, Jr.

When constructing a floating pier, floats are typically arranged to form an elongated mainwalk having a large number of spaced-apart finger floats projecting from the mainwalk. Boats are then typically moored on opposite sides of each finger float.

The mainwalks are formed by arranging a plurality of individual mainwalk floats end to end. The individual floats are then secured to one another using elongated wooden walers which extend along the sides of adjoining floats and are secured to the floats to join adjacent floats together. The finger floats normally abut the side of the mainwalk floats or walers and project perpendicularly outward. Some form of bracing, such as triangular braces including a deck portion, is generally used to secure the finger floats to the mainwalk.

While concrete marine floats of the type described above work well for projects such as a typical floating pier assembly, there remain several drawbacks to the conventional designs.

Conventional concrete floats are not readily adaptable to a wide range of configurations using a minimum number of standard unit types. Relatively wide mainwalk floats and narrower finger floats are commonly assembled into a pier structure. To produce double-width mainwalk portions or 1½-width mainwalk portions a manufacturer would, until now, have to fabricate special forms for each special float size desired. Furthermore, conventional floats are not well adapted for use in other non-pier structural configurations, such as large rectangular floating foundations.

Another disadvantage of conventional float assemblies is that the end-to-end waler connections typically used are relatively flexible. This flexibility may tend to distribute loads unevenly to the piles and can cause discomfort to persons walking on the float assemblies. Additionally, the wood to concrete connections inherent in the end-to-end waler connections create potential failure points at every material discontinuity.

DISCLOSURE OF INVENTION

It is an object of this invention to provide a modular float system for constructing floating piers, platforms, and other buoyant structures.

It is another object of this invention to provide such a system which will enable a plurality of configurations to be assembled from a limited number of float unit types.

It is another object of this invention to provide such a system which will enable marine structures to be assembled which can provide increased buoyancy to portions of the structure for supporting heavily weighted portions of the structure.

It is another object of this invention to provide modular units for use in such a float system.

These and other objects, which will become more apparent as the invention is more fully described below, are obtained by providing a float system comprised of modular units which are assembled to form relatively rigid floating assemblies in a plurality of configurations.

In a preferred embodiment comprising a basic two-tier assembly, the modular units form upper and lower layers which combine to define a protective shell. Each individual modular unit includes a top/bottom surface and a pair of sidewalls and end walls which extend outwardly from the edges thereof. The units are preferably interchangeable so that they may be used for either the upper or lower layer and are assembled in a staggered manner to form overlapping connections.

The modular units of this invention may be assembled to form pier structures, as well as other floating structures, including buoyant foundations and relatively large rectangular floats. The modular units may be assembled into more than two layers if desired for increased buoyancy. Preferred embodiments also include assemblies comprised of a buoyant and a non-buoyant upper layer which are connected in a staggered manner in accordance with the present invention. Preferred embodiments for unevenly loaded structures include multilayer portions at locations on the structure corresponding to increased loads.

In preferred embodiments, several fractionally sized modular units having related dimensions are provided to give flexibility in the design and sizing of structures with a minimum number of basic modular units.

BRIEF DESCRIPTION OF THE DRAWINGS

FIG. 3 is a top plan view illustrating the corner of two modular units assembled together using a connection rod assembly.

FIG. 4 is a cross-sectional view of a connection rod assembly taken through line 4—4 of FIG. 3.

FIG. 5 is a cut-away view illustrating the upper portion of a connection rod assembly with a piece of hardware mounted on the deck.

FIG. 6 is a schematic illustration of a bottom layer layout for a pier structure having a 1½-width mainwalk pier assembly.

FIG. 7 is a schematic illustration of an upper layer layout for the pier structure of FIG. 6.

FIG. 8 is a schematic illustration of an alternative layout for the bottom layer of a pier structure having 0 a $1\frac{1}{2}$-width mainwalk.

FIG. 9 is a schematic illustration of an upper layer layout corresponding to the lower layer layout of FIG. 8.

FIG. 10 is a schematic illustration of a layout for a square floating structure.

FIG. 11 is a schematic illustration of a layout for a rectangular structure assembled from modular units of the present invention.

FIG. 12 is an exploded isometric view of a rectangular floating structure assembled with modular units from the present invention, with the lower layer illustrated schematically.

FIG. 13 is a side elevation schematic illustrating a floating structure having a multilayer portion for supporting an area of increased weight.

FIG. 15 is an isometric view of a preferred embodiment including a buoyant lower layer and a non-buoyant upper layer.

FIG. 16 is an isometric view illustrating a preferred embodiment having two buoyant lower layers and a non-buoyant upper layer.

BEST MODE FOR CARRYING OUT THE INVENTION

In preferred embodiments of the invention, floating structures are constructed by assembling a plurality of prefabricated modular units into upper and lower layers. The modular units of these layers are connected to one another in a staggered manner to form a relatively rigid protective outer shell.

In one group of preferred embodiments, floating structures are formed by modular units having a concrete shell surrounding a buoyant core. The shell preferably includes at least one open face to reduce the cost of construction. A typical structure is formed by a lower layer of units having the open face positioned on the top of the units, and an upper layer of inverted units having the open face positioned on the bottom of the units. The modular units of each layer are joined to form a closed concrete shell.

Figure 2:
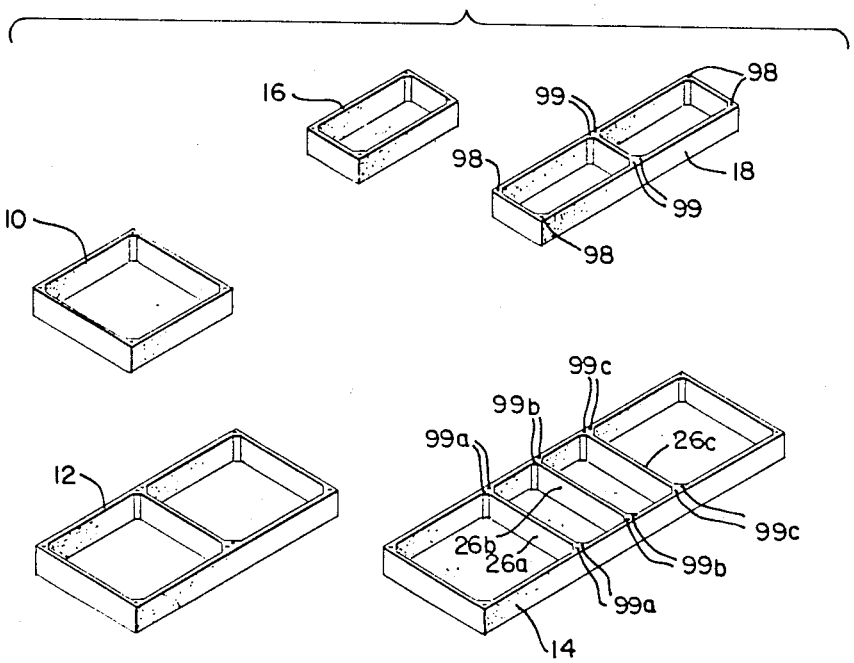
FIG. 2 is an isometric view of several modular units in accordance with the present invention.

A group of typical modular units in accordance with a preferred embodiment of the invention is illustrated in FIG. 2. Full-width units 10, 12, 14 (which can be used for constructing mainwalk sections of piers) and half-width sections 16, 18 (which can be used for constructing finger walks) are shown. The modular units are preferably constructed in a number of lengths proportional to the width of a full-width unit, such that a single-length unit 10, 16 has a length equal to the width of a full-width unit. Typical modular units groups will also include double-length units 12, 18 and triple-length units 14.

The sizes of modular units will be designated herein by stating their fractional length and width in relation to the width of a full-width unit. Thus, for a group where a full-width unit is 3 feet wide, a $2\times\frac{1}{2}$ unit will designate a modular unit which is 6 feet long and 1.5 feet wide.

Figure 2A:
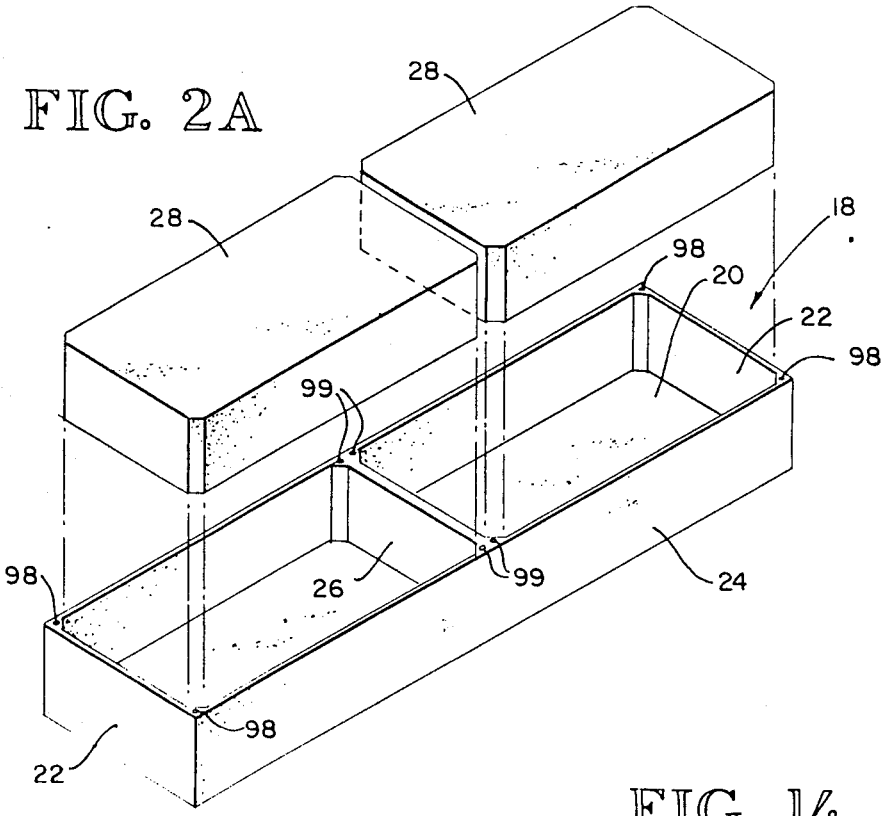
FIG. 2A is an isometric view of a 2×1 unit with the foam cores shown in an exploded position.

Each unit includes a bottom/top surface 20 and end walls 22 and sidewalls 24 which extend outwardly from the edges of the bottom/top surface (see FIG. 2A). Modular units which are longer than single-length units preferably include an interior connection wall 26 to facilitate staggered connections of the units as described below. Foam cores 28 are preferably placed in the interior of the modular units and extend between the sidewalls and end walls and/or interior connection walls of the units. It is possible to completely encase the foam core by providing a surface opposite the bottom/top surface, but such surface is preferably omitted in the interest of economy. While the modular units of the preferred embodiment described herein include concrete shells and foam cores, other materials would, of course, be used in place of the concrete and foam. It is not intended that the present invention be limited to these materials, as it is recognized that the invention will function using substitute materials.

Figure 1:
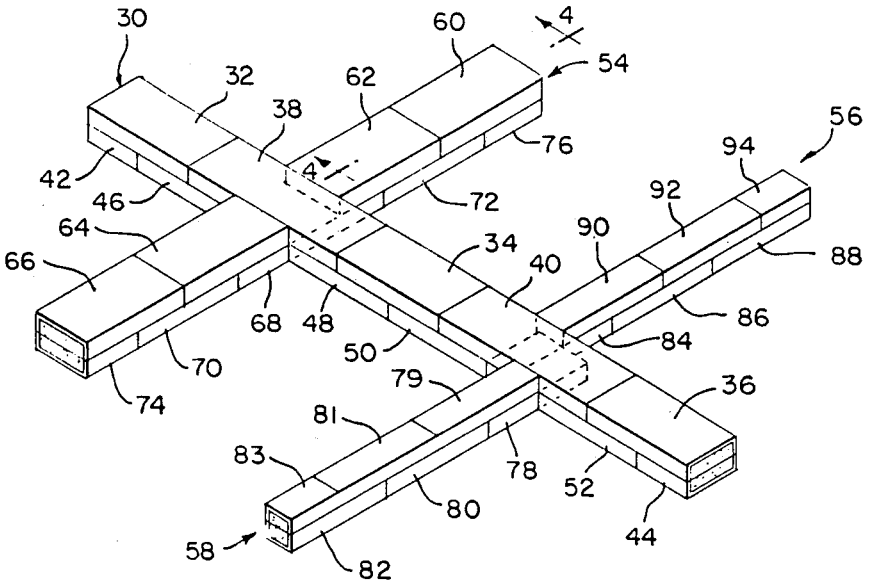
FIG. 1 is an isometric view of a floating pier structure assembled with modular units according to the present invention.

The modular units are assembled by staggering an upper layer of units with respect to a lower layer of units and joining the two layers together using suitable connection means. A preferred embodiment of a floating pier assembled in this manner is illustrated in FIG. 1. A full-width mainwalk 30 is assembled using $2\times1$ units 32, 34, 36 and $3\times1$ units 38, 40 to form an upper layer. A lower layer is formed of $1\times1$ units 42, 44; $2\times1$ units 46, 48, 50, 52; and portions of the finger walk units (as described below). The lower layer is staggered beneath the upper layer such that only at the outer ends of the elongated mainwalk do the end walls of the upper layer units and lower layer units align with one another. This staggering provides relatively rigid connections between the units and enables the mainwalk to function as a single structure for increased rigidity.

The floating pier illustrated in FIG. 1 also includes a full-width finger walk 54 and two half-width finger walks 56, 58 which extend outwardly from the mainwalk. The full-width finger walk extends outwardly in opposite directions from the mainwalk and is formed by an upper layer comprised of four $2\times2$ units 60, 62, 64, 66, two of which extend outwardly from the mainwalk in each direction, as seen in FIG. 1. The lower layer is formed by a $3\times1$ unit 68 which extends through the lower layer of the mainwalk. The interior one-third of the $3\times1$ unit is connected to the upper layer of the mainwalk and forms a portion of the lower layer of the mainwalk. The outer thirds of the $3\times1$ unit extend outwardly from the mainwalk in opposite directions, as shown in FIG. 1. The remainder of the lower layer is formed by $2\times1$ units 70, 72 and $1\times1$ units 74, 76 at the outer ends.

A first half-width finger walk 58 includes a lower layer formed by $2\times\frac{1}{2}$ units 78, 80, 82. The innermost unit 78 extends under the mainwalk and forms part of the lower layer of the mainwalk. A pair of $2\times\frac{1}{2}$ units 79, 81 and a $1\times\frac{1}{2}$ unit 83 form an upper layer to complete a finger walk.

A second half-width finger walk 56 is adjacent to the first and extends outwardly from the mainwalk in a direction opposite to the first half-width mainwalk. A connecting $2\times\frac{1}{2}$ unit 84 extends out of the mainwalk and forms part of the mainwalk. Additional $2\times\frac{1}{2}$ units 86, 88 combine with the connecting unit to form the lower layer. The upper layer of the second half-width finger walk 56 is formed by $2\times\frac{1}{2}$ units 90, 92 and a $1\times1$ unit 94 at the outer end of the finger walk.

In preferred embodiments, the modular units include connection conduits 98 which extend through the walls of the modular unit and form a passage between the top/bottom surface and the open face of the unit. Connection conduits are located at each corner of the unit, as seen in FIGS. 2A and 3. Additionally, double-length units include a pair of connection conduits 99 at the intersection of the connection wall 26 with the sidewalls. As seen in FIG. 2, a triple-length unit 14 preferably includes three connection walls *26a, 26b, 26c* at the one-third, one-half and two-thirds longitudinal points, respectively. Corresponding pairs of connection conduits *99a, 99b, 99c* are placed at the intersection of each respective connection wall with the sidewalls to facilitate staggering as described below.

In the preferred embodiments illustrated herein, the modular units of the upper layers and lower layers are connected by means of connection rods 96 which are inserted through the connection conduits in the upper and lower units. Each modular unit includes a plurality of connection conduits 98 which extend from the top/-bottom surface of each unit to the open face of the unit. When the structure is assembled, the units of the upper layer and lower layer are positioned so as to align pairs of connection conduits to form a single passageway through which the connection rods extend.

FIGS. 3 and 4 illustrate a typical connection rod assembly An upper unit 100 and lower unit 100' are aligned with their respective connection conduits 98, 98', forming a single passageway. Each conduit includes a PVC liner 102, 102'. A connection rod 96 having threaded ends extends through the connection conduits to hold the upper and lower units together. A washer 104 and nut 106 are attached to each end of the connection rod to hold it in place and allow the upper and lower units to be pulled tightly together by adjusting the nuts. A PVC or other end cap 108 fits tightly over each nut to seal the connection conduits. Grease or similar preservative (not shown) can be placed in the connection conduits to retard corrosion.

An alternative embodiment of a connection assembly is illustrated in FIG. 5. An extended nut 106' is secured to the top portion of the connection rod 96. A piece of hardware 112 is mounted on the top of the structure 114 by inserting a bolt 110 through an aperture 116 in the hardware, and screwing the bolt into the top end of the extended nut.

Figure 14:
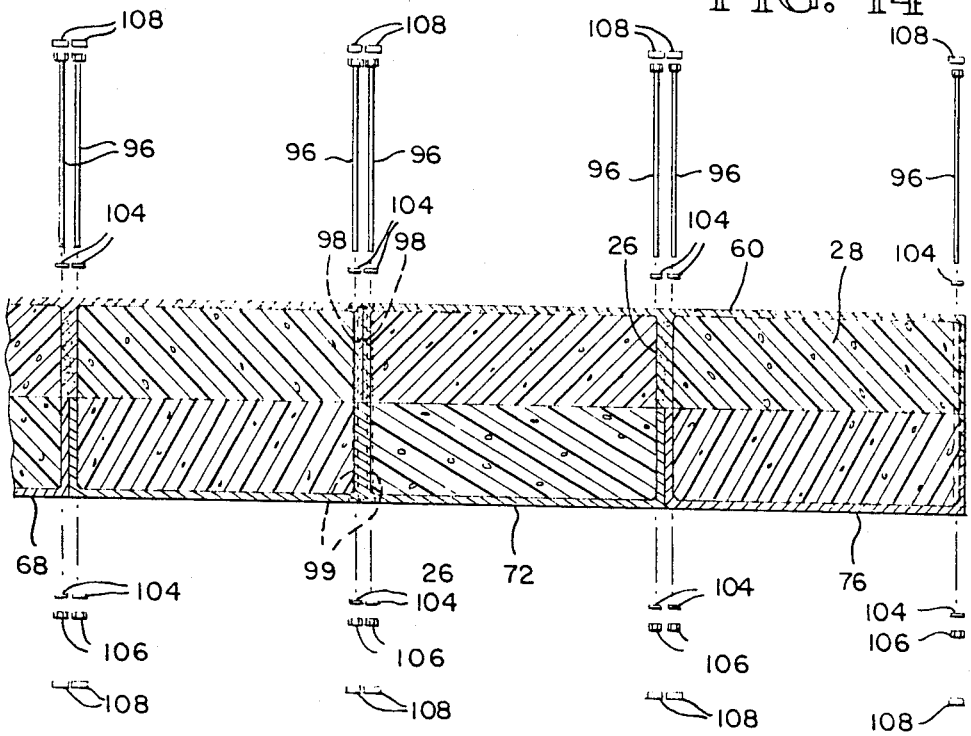
FIG. 14 is a longitudinal cross-sectional view illustrating the staggered connections of a finger float in the floating pier structure of FIG. 1.

The staggered connections of the full-width finger float 54 illustrated in FIG. 1 are shown in the longitudinal cross-section of FIG. 14. The outermost portion of the bottom layer is formed by a 1×1 unit 76. Abutting this 1×1 unit is a 2×1 unit 72. Positioned inwardly from the 1×1 unit is a 3×1 unit 68 which extends under the mainwalk to the other side of the finger The top layer is formed by a pair of 2×1 units 60, walk. 62. A plurality of connection rods 96 holds the upper layer and lower layer together. The adjacent ends of the 1×1 lower layer unit 76 and the adjacent 2×1 unit 72 include connection conduits at the corners which are aligned with respective conduits and the connection wall 26 of the 2×1 unit 60 positioned directly above these units in the upper layer. Thus, while there is an abutting connection in the lower layer between two units 72, 76, the portion of the upper layer directly above this abutting connection comprises a single 2×1 unit. Similarly, the abutting connection between upper layer units 60, 62 is met by a corresponding single unit 72 in the lower layer.

FIGS. 6 through 13 illustrate some of the design flexibility inherent in structures designed with the modular units of this invention. For each design, staggered connections can be made in the same manner described above, and hence the details of such connections are not illustrated herein.

FIG. 6 represents schematically the layout of the lower layer of modular units for a segment of a floating pier design. FIG. 7 represents a corresponding upper layer design. Reference lines A and B in each figure illustrate common points on the upper and lower layers of the pier. In the layout illustrated in FIGS. 6 and 7, a mainwalk is comprised of a combination of full-width and half-width units to provide a mainwalk with a width equal to 1.5 times the width of a typical unit. Special 2.5×1 units 118, 120, 122, 124 are provided to allow full-width finger walks to extend outwardly from the mainwalk 117 as seen in FIG. 6. The upper layer illustrated in FIG. 7 is formed by 4×1 units 126, 128 in conjunction with 2×1 units 130, 132 and 2×½ units 134, 136, 138, 140, 142, 144. As indicated by reference lines A and B in FIGS. 6 and 7, the mainwalk sections of the upper and lower layers do not align. The layout shown here is designed to be part of an extended mainwalk section, and thus the extended portions of the units 146, 148 of the lower layer adjacent reference line A in FIG. 6 would be joined with cantilevered portions of the upper layer of an adjacent segment. 1.5×1 units (not shown) can be placed transversely above or below the extended units to terminate the mainwalk at a given segment.

FIGS. 8 and 9 illustrate an alternative layout employing one-half width finger walks. Again, reference lines A and B indicate common locations on the upper and lower layers. A mainwalk segment 150 is formed by the lower layer illustrated in FIG. 8, including 2×1 units 152, 154, 156, 158, 160, 162 and 2×½ units 164, 166, 168, 170, 172, 174 which extend longitudinally. Special 2.5×½ units 176, 178, 180, 182, 184, 186 extend transversely from the mainwalk to form finger walks, as seen in FIG. 8. The upper layer of this layout is illustrated schematically in FIG. 9. 3×1 units 188, 190, 192 and 3×½ units 194, 196, 198 combine with 2×1 unit 200, 202, 204 and 2×½ units 206, 208, 210 to form the top portion of the mainwalk 150. 2×½ units 212, 214, 216, 218, 220, 221 extend transversely from the mainwalk and cantilever beyond the corresponding lower layer transverse sections to allow the finger walks to be extended outwardly from the mainwalk.

FIGS. 10, 11 and 12 illustrate several possible arrangements for non-pier structures assembled from the modular units of the present invention. FIG. 10 illustrates a square structure formed by a bottom layer comprised of a pair of 2×1 units 222 (shown in phantom line) and an upper layer comprised of a pair of transversely positioned 2×1 units 224.

FIG. 11 illustrates a similar arrangement wherein the bottom layer is made up of a pair of 3×1 units 226 and the top layer is made up of a transversely positioned trio of 2×1 units 228.

FIG. 12 illustrates another rectangular structure. A top layer is formed by a group of 3×1 units 228. The bottom layer is formed by 3×1 units, 2×1 units and 1×1 units in combination, as illustrated.

Although the invention has been described thus far primarily with respect to two tier structures, it is possible to have more than two layers of units combined together. To form a structure having more than two layers, it is merely necessary to align the multiple layers and provide suitably long connection rods for joining them together. An example of such a structure is illustrated in FIG. 13. A floating foundation 230 is comprised of an upper layer 232, a lower layer 234 and a tertiary layer 236. As can be seen from FIG. 13, the tertiary layer does not need to extend along the entire structure but may be limited to an area where an increased weight W is to be placed on the structure. This structure illustrates the flexibility of the present design, in that it allows not only multilayers but allows the layers to be stepped along the structure as desired.

FIG. 15 illustrates a preferred embodiment which includes a buoyant lower layer 240 and a non-buoyant upper layer 242. The lower layer is comprised of modular units 244, 246 including buoyant cores 248 and having the same basic structure as the modular units 10, 12, 14, 16, 18 described above. The upper layer is formed by top units 250 having an inverted U-shaped cross-section. The top units include connection conduits 252 and are mounted to the modular units of the bottom layer in a staggered manner preferably using the same type of connection rod assemblies disclosed in FIGS. 3–5. As seen in FIG. 15, the hollow inner portion of the top units forms a passageway 254 between the top of the assembly and the top of the lower layer through which conduits 256 may be routed.

FIG. 16 illustrates a preferred embodiment comprising two buoyant lower layers 258, 260 comprised of modular units and an upper deck layer 262. The two lower layers are formed by modular units 264 stacked open face upwardly in a staggered manner with their connection conduits 266 appropriately aligned. The upper layer is formed by a wooden deck including side members 268 attached to support members 270 which rest on the sidewalls of the uppermost lower layer 260. The walking surface is formed by transverse planks 272. The deck layer includes connection conduits 274 which extend through the support members and planks to provide passageways through the entire assembly to allow the layers to be connected using suitable connection means such as those described earlier.

Although the invention has been described and disclosed herein with respect to particular embodiments, it is not intended that the invention be limited to such embodiments. Rather, it is intended that the invention encompass all embodiments within the spirit of the invention.

We claim:

1. A floating marine dock structure comprising:

a plurality of modular float units coupled together to form a marine dock, each modular float unit including a buoyant core and a shell of protective material around the core, the shell including a bottom surface, sidewalls and end walls, the modular float units abutting one another to form a lower layer of the floating structure and an upper layer of the floating structure, the modular float units of the lower layers being staggered with respect to the modular float units of the upper layer; and means for rigidly connecting the modular float units of the upper layer to the modular float units of the lower layer, the connecting means extending substantially from a top region of said upper layer to a bottom region of said lower layer for applying vertical compression to the floating structure to restrain vertical movement of the modular float units.

2. The floating structure of claim 1 wherein the connecting means comprises:

a plurality of passages extending vertically through the modular float units, at least some of the passages of the upper layer and lower layer being aligned to provide a continuous passageway through the floating structure; and connection rods positioned in the aligned passages of the upper and lower layers, the connection rods including vertical compressing means for enabling the modular float units of the upper and lower layers to be connected under vertical compression.

3. A floating deck structure including an elongated mainwalk and a finger walk extending transversely outward from the mainwalk, the floating deck structure comprising:

a plurality of modular float units, each modular float unit including a buoyant core and a shell of protective material around the core, the shell including a bottom surface, sidewalls and end walls, a first group of the modular float units abutting one another to form an upper layer of the mainwalk, a second group of the modular float units extending transversely outward from the mainwalk and abutting one another to form the upper layer of the finger walk with the innermost modular float unit abutting a sidewall of a modular float unit of the upper layer of the mainwalk, a third group of modular float units abutting one another to form the lower layer of the mainwalk and the finger walk, the modular float units of the upper layer of the floating deck structure being staggered with respect to the modular float units of the lower layer of the floating deck structure with the innermost modular float unit of the lower layer of the finger float extending beneath the upper layer of the mainwalk to form a portion of the lower layer of the mainwalk; and means for rigidly connecting the modular float units of the upper and lower layers.

4. The floating deck structure of claim 3 wherein the connecting means includes means for applying vertical compression to the floating deck structure to restrain vertical movement of the modular float units.

5. A modular float unit which comprises:

a horizontal surface;

two opposed end walls;

two opposed elongated sidewalls extending between the end walls and forming four corners at the respective intersections of the end walls and sidewalls;

a plurality of vertical connection passages which extend vertically through the modular float units at each corner and at locations along each sidewall corresponding to a fraction of the length of the sidewall equal to the distance between the vertical connection passages at said corners along said end walls to enable the modular float units to be assembled in vertical layers into a plurality of different configurations, with the passages of the units of the layers aligned with respect to one another.

6. A floating structure comprising:

a lower layer including a plurality of longitudinally extending structural lower modules, said lower modules being buoyant;

said lower modules including a rigid shell having a rigid bottom, rigid sidewalls and rigid end walls, said sidewalls and said end walls having respective top and bottom surfaces;

a plurality of vertical passageways extending into said lower module end walls;

a plurality of vertical passageways extending into said lower module sidewalls;

an upper layer formed on top of said lower layer, said upper layer including a plurality of longitudinally extending structural upper modules;

said upper modules including a rigid shell having a rigid top, rigid sidewalls and rigid end walls, said sidewalls and said end walls having respective top and bottom surfaces;

a plurality of vertical passageways extending substantially through said upper module end walls, substantially from respective end wall top surfaces to respective end wall bottom surfaces;

a plurality of vertical passageways extending substantially through said upper module sidewalls, substantially from respective sidewall top surfaces to respective sidewall bottom surfaces;

a plurality of rigid bolts applying vertical compression to hold said upper and lower layers together, said bolts extending from said upper layer sidewall passageways into said lower layer end wall passageways and from said upper layer end wall passageways into said lower layer sidewall passageways such that said end walls of upper and lower layers are staggered with respect to each other to form a mainwalk.

7. The floating structure of claim 6 wherein said lower modules further include a buoyant core.

8. The floating structure of claim 6 wherein said upper modules are buoyant and include a buoyant core.

9. The floating structure of claim 6 wherein said upper modules are not buoyant.

10. The floating structure of claim 6 wherein an end wall passageway and a sidewall passageway of said lower module are aligned with a sidewall passageway of said upper layer having bolts extending substantially through respective upper sidewalls passageways and said lower end wall and sidewall passageways to retain said lower module extending longitudinally perpendicular to said mainwalk to form a finger walk.

11. The floating structure of claim 6 wherein said lower module end wall and sidewall passageways extend completely through said lower module.

12. The floating structure of claim 6 wherein said rigid shell is concrete.

13. The floating structure of claim 6 wherein said end walls of said lower layer abut one another along the entire length of said mainwalk.

14. The float system according to claim 11 wherein said rigid shell is comprised of concrete.

15. The floating structure of claim 6 wherein said upper modules and said lower modules are interchangeable with each other.

16. A floating structure comprising:

a lower structural layer having a plurality of longitudinally extending lower modules, each of said lower modules being a longitudinally extending beam;

said lower modules including a rigid outer shell having a rigid top surface and a rigid bottom surface;

a plurality of vertical passageways extending through said lower module, from said top surface to said bottom surface;

an upper structural layer including a plurality of longitudinally extending upper modules, each of said upper modules being a longitudinally extending beam;

said upper modules including a rigid outer shell having a rigid top and a rigid bottom surface;

a plurality of vertical passageways extending through said upper module, from said top surface to said bottom surface;

a plurality of rigid bolts applying vertical compression to hold said upper and lower layers together, said upper and lower layers being staggered with respect to each other, said bolts extending from said upper layer top surface to said lower layer bottom surface to retain said floating structure in a longitudinally extending beam.

* * * * *